United States Patent [19]

Magnan

[11] 4,336,761

[45] Jun. 29, 1982

[54] AUTOMATIC SEWING APPARATUS

[75] Inventor: Alfredo J. Magnan, Miami, Fla.

[73] Assignee: Suave Shoe Corporation, Miami Shores, Fla.

[21] Appl. No.: 152,482

[22] Filed: May 22, 1980

[51] Int. Cl.[3] ..... D05B 21/00

[52] U.S. Cl. ..... 112/121.12; 112/317

[58] Field of Search ..... 112/121.12, 121.11, 112/317, 235, 102, 2

[56] References Cited

U.S. PATENT DOCUMENTS 3,599,583 8/1971 Berman et al. ..... 112/121.12

3,988,993 11/1976 Brophy ..... 112/121.12

4,169,422 10/1979 Hayes et al. ..... 112/121.12

4,236,468 12/1980 Eguchi ..... 112/317 X

*Primary Examiner*—Peter P. Nerbun

*Attorney, Agent, or Firm*—Shapiro and Shapiro

[57] ABSTRACT

In an automatic sewing apparatus, a relay controlled by a backstitch control switch de-energizes a presser foot solenoid to raise the presser foot during backstitching to prevent damage that would result from the presser foot striking a pallet holding a workpiece. A switch, adapted to be actuated by the pallet, disables the operation of the sewing apparatus until the pallet is in a predetermined aligned position with respect to a support carriage which moves the pallet in a predetermined pattern with respect to the sewing head.

11 Claims, 3 Drawing Figures

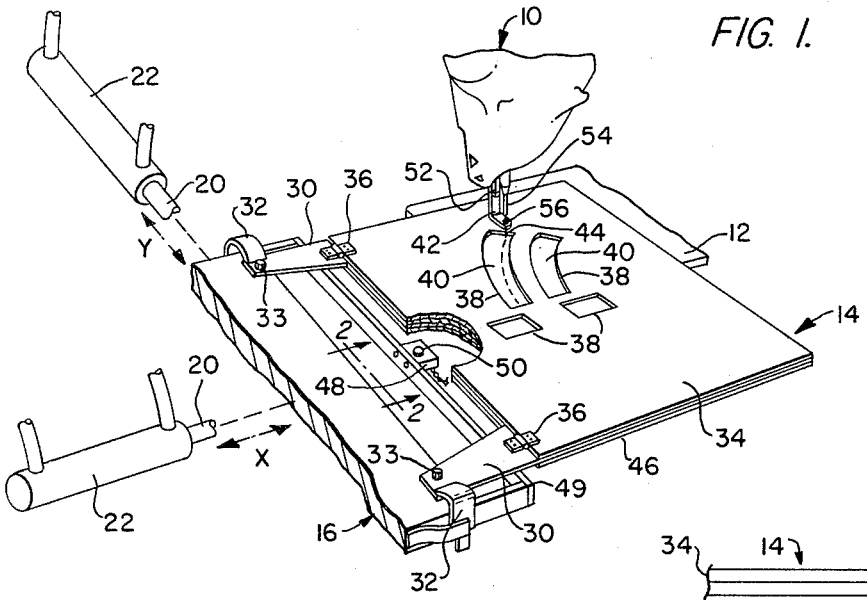
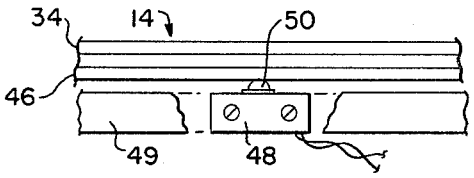
FIG. 3.
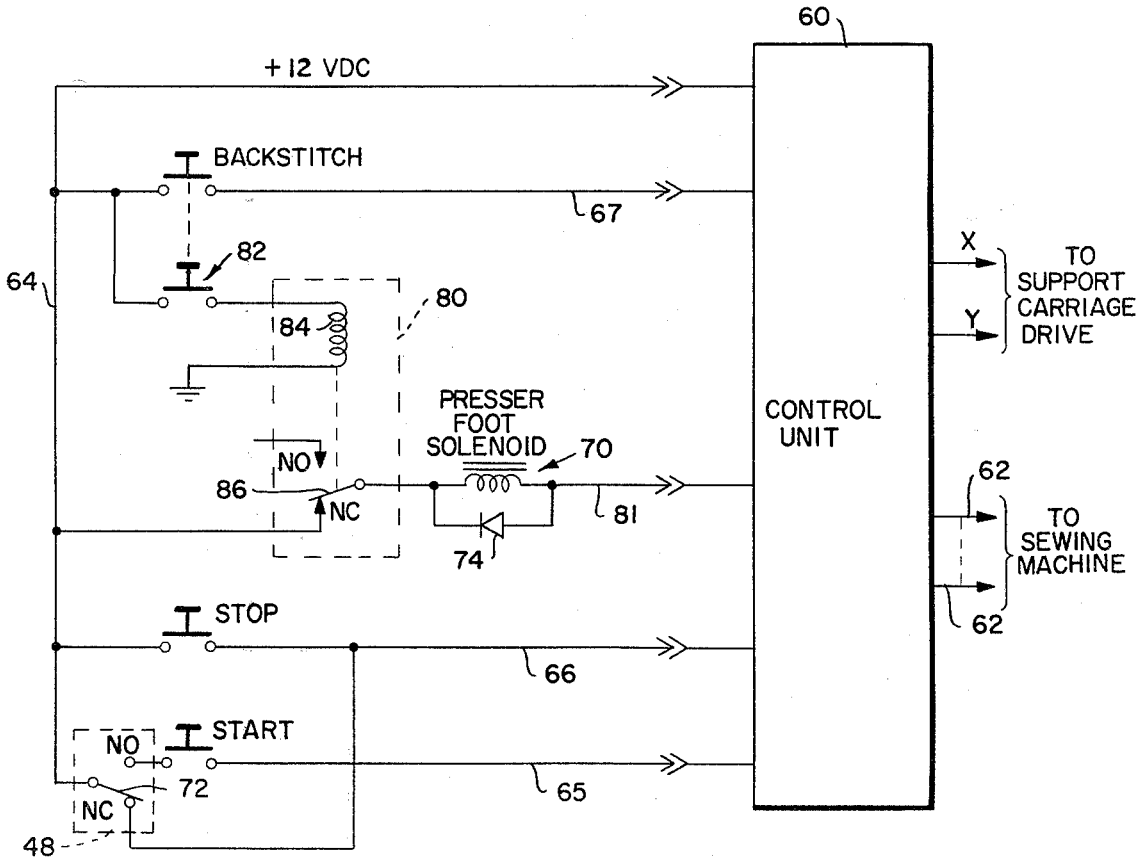

AUTOMATIC SEWING APPARATUS

BACKGROUND OF THE INVENTION

The present invention relates generally to automatic sewing apparatus, and in particular to automatic sewing apparatus having means for preventing damage to the apparatus during certain modes of its operation, or due to improper operation.

In the mass production of clothing, shoes, and the like, it is common to use automatic sewing apparatus which automatically move a workpiece in a predetermined pattern relative to a sewing head for stitching. The workpiece is supported on a movable support carriage, the movement of which may be controlled in a predetermined manner by a numerical or direct digital control system. Because the workpiece materials used for clothing or shoes are rather flaccid, e.g. cloth or leather, the workpiece is generally held within a pallet, such as disclosed, for example, in U.S. Pat. No. 3,988,993 to Brophy, issued Nov. 2, 1976, comprising plates which are assembled in a sandwich-type arrangement. Aligned openings or cut-outs are provided in the plates adjacent to areas of the workpiece to be stitched to permit access to the workpiece by the presser foot and the needle of the sewing head. The pallet is mounted on the support carriage, and the control system automatically moves the support carriage to position a cut-out below the sewing head, lowers the presser foot to engage the workpiece within the cut-out, and moves the carriage in a predetermined pattern so that the workpiece is stitched along a path within the cut-out. Upon completion of a stitching operation, the control system automatically raises the presser foot, moves the support carriage to position the next cut-out below the sewing head, and performs another stitching operation.

If the thread breaks or the bobbin runs out during stitching, it is necessary to backstitch over the holes in the material that do not have thread. This is accomplished by backtracking along the previously stitched path. During backstitching, however, the presser foot may not be automatically raised when it comes to the edge of a cut-out. Accordingly, the presser foot may strike the pallet, causing damage to the presser foot or the presser foot suspension bar, necessitating down time of the apparatus and costly maintenance to replace the damaged parts. Moreover, if the pallet is not properly aligned with respect to the support carriage prior to beginning a sewing operation, the cut-outs in the pallet will not be properly positioned with respect to the sewing head. This may allow the presser foot or the needle to strike the pallet, causing damage to the sewing head.

SUMMARY OF THE INVENTION

Accordingly, it is a principal object of the invention to provide an automatic sewing apparatus which incorporates means for preventing damage to the apparatus during a backstitching operation.

Another object of the invention is to provide an automatic sewing apparatus which incorporates means for preventing damage to the apparatus due to the misalignment of a pallet with respect to a movable support carriage.

Briefly stated, in one aspect the invention provides, in an automatic sewing apparatus having a sewing head, a pallet for holding a workpiece to be sewn, means for moving the pallet relative to the sewing head according to a predetermined pattern for stitching the workpiece and for backstitching, the sewing head including a presser foot for engaging the workpiece and needle means for stitching the workpiece, and first and second control means for initiating stitching and backstitching, respectively, the improvement comprising means responsive to the operation of the second control means for preventing the presser foot from engaging the workpiece during backstitching.

In accordance with another aspect of the invention, there is provided, in an automatic sewing apparatus having a sewing head, a pallet for holding a workpiece to be sewn, movable support means on which the pallet is adapted to be mounted, and means for moving the support means relative to the sewing head according to a predetermined pattern for stitching the workpiece, the improvement comprising means dependent upon the positioning of the pallet on the support means for inhibiting the operation of the apparatus unless the pallet and the support means have a predetermined alignment.

BRIEF DESCRIPTION OF THE DRAWINGS

FIG. 1 is a combined fragmentary perspective view, partially broken away, and a diagrammatic view of a portion of an automatic sewing apparatus;

FIG. 2 is a fragmentary elevational view, partially broken away, taken approximately along the line 2—2 of FIG. 1; and FIG. 3 is a schematic diagram of a portion of a control system in accordance with the invention for use in an automatic sewing apparatus.

DESCRIPTION OF THE PREFERRED EMBODIMENT

The present invention is particularly adapted for use in automatic sewing apparatus of the type disclosed, for example, in U.S. Pat. No. 4,114,545 to Manabe et al., issued Sept. 19, 1978, and U.S. Pat. No. 4,160,422 to Barber et al., issued July 10, 1979, the disclosures of which are incorporated herein by reference. Since the present invention is primarily concerned with improvements in the control systems of such sewing apparatus, only so much of the sewing apparatus as is necessary for an understanding of the invention will be described. Reference may be had to these patents for further details of the sewing apparatus.

As shown in FIG. 1, a sewing apparatus generally comprises a sewing machine having a fixed sewing head 10, which may be connected to an arm (not illustrated), and a sewing bed 12 for supporting a workpiece. The workpiece may be held in a pallet 14 of the type disclosed in the previously mentioned U.S. Pat. No. 3,988,993 to Brophy, the disclosure of which is incorporated herein by reference. The pallet 14 may be mounted on a movable support carriage 16 for moving the workpiece with respect to the sewing head for stitching, as will be explained. The sewing apparatus further includes a support carriage drive mechanism, which for purposes of illustration is shown diagrammatically in FIG. 1 as comprising a pair of pneumatically driven piston rods 20 controlled by pneumatic cylinders 22. The piston rods may be connected to the support carriage for moving it along two axes designated as X and Y in FIG. 1, which lie in a horizontal plane below the sewing head. Alternatively, the support carriage drive mechanism may be an electrical motor-cable arrangement of the type illustrated in the afore-referenced Manabe patent. In any event, the support carriage drive mechanism permits the workpiece-holding pallet to be positioned and moved in a predetermined pattern with respect to the sewing head for stitching, as is well known.

As described in the afore-referenced Brophy patent, pallet 14 comprises several plate members, as of metal, assembled in a sandwich type arrangement having an inner cavity which receives the workpiece. The pallet has a pair of mounting arms 30 adapted for engagement with corresponding mounting brackets 32 on the support carriage. Fasteners 33 connect the pallet to the support carriage. A cover plate 34 of the pallet is connected to the mounting arms by hinges 36 so that the pallet may be opened in a book-like manner to provide access to the inner cavity and to the workpiece.

The pallet is adapted to be mounted in a predetermined aligned position on the support carriage by virtue of the engagement between the mounting arms 30 and the mounting brackets 32, and to be held in position by fasteners 33. However, if the fasteners are not properly secured, or if an operator fails to use the fasteners, relying on the brackets to hold the pallet in position, the pallet may move with respect to the support carriage. This results in the pallet and the workpiece being improperly positioned with respect to the sewing head 10 and may result in damage to the sewing head, as will be explained. Also, the mounting brackets and fasteners may fail to hold the pallet in aligned position on the support carriage, permitting damage to the sewing head. As will be explained shortly, the invention provides means for preventing such damage.

As shown in FIG. 1, cover plate 34 has a plurality of cut-outs or openings 38 arranged therein in a predetermined manner. The cut-outs are positioned adjacent to areas 40 of the workpiece that are to be stitched, and provide access to these areas for a presser foot 42 and a stitching needle 44 of the sewing head 10. A matching pattern of cut-outs (not illustrated) is provided in a bottom plate 46 of pallet 14. Pallet 14 serves to securely hold the workpiece, which may comprise overlays of different layers of material, in accurate registration for stitching.

As also shown in FIG. 1, a limit switch 48 is supported on a bracket 49 attached to support carriage 16. The limit switch is positioned adjacent to the bottom plate 46 of pallet 14 (FIG. 2) when the pallet is mounted on the support carriage, and has a pushbutton 50 adapted to be engaged by bottom plate 46 to actuate the switch (for a purpose which will be explained shortly) when the pallet is aligned with the support carriage.

As shown in FIG. 1, presser foot 42 is suspended below sewing head 10 on a presser foot suspension bar 52 which is adapted to be lowered and raised, as will be explained, to cause the presser foot to engage the workpiece during stitching. Needle 44 is carried in a needle bar 54 depending from sewing head 10, and may pass through an opening 56 in the presser foot. Needle bar 54 is adapted to move the needle up and down in a well-known manner for stitching the workpiece.

The operation of the automatic sewing apparatus may be controlled by a control system such as illustrated schematically in FIG. 3. The control system includes a control unit 60, shown as a block in FIG. 3, which may contain all of the necessary circuitry for controlling the operation of the sewing apparatus. The control unit may have a plurality of output leads 62 connected to various operating components of the sewing machine for controlling its operation. The control unit may also have outputs X and Y which may be connected to the support carriage drive mechanism for controlling the movement of the support carriage. Outputs X and Y may control pneumatic valves (not illustrated), for example, which supply air to pneumatic cylinders 22. Control unit 60 may further include a computer for controlling the overall operation of the sewing apparatus, and the computer may include a stored program for controlling the movement of the support carriage in accordance with the stitching operation which is to be performed on the workpiece.

Various operator actuated control devices, such as pushbutton switches, may be provided on an operator's panel (not illustrated) to allow an operator to control various functions of the sewing apparatus. For example, FIG. 3 illustrates START, STOP, and BACKSTITCH pushbuttons which allow an operator to start and stop the sewing apparatus and to perform a backstitching operation. Of course, additional pushbuttons may be provided to permit operator control of other functions of the apparatus. In the form illustrated in FIG. 3, the STOP and the BACKSTITCH pushbuttons may each have one terminal connected to a supply voltage line 64 which carries a voltage such as +12 VDC, for example. The START pushbutton is connected to supply voltage line 64 through limit switch 48, as will be explained. Another terminal of the START, STOP, and BACKSTITCH pushbuttons may be connected to an associated control circuit (not illustrated) in control unit 60 by means of control lines 65, 66 and 67, respectively. When a pushbutton is operated, the voltage on voltage supply line 64 is applied through the pushbutton to its associated control circuit in control unit 60 via the control lines, to initiate a particular control function.

To perform a sewing operation, an operator mounts a pallet 14 containing a workpiece on the support carriage 16 and initiates the sewing operation by depressing the START pushbutton. The control unit automatically supplies the appropriate X and Y control signals to the support carriage drive mechanism to position a first cut-out 38 below sewing head 10. Once the cut-out is in position, the control unit energizes a presser foot solenoid 70 (FIG. 3) to cause presser foot 42 to be lowered into the cut-out and to engage the workpiece. The presser foot solenoid may control a pneumatic valve (not illustrated), for example, and the presser foot may be lowered and raised pneumatically. A diode 74 may be placed in parallel with the presser foot solenoid (FIG. 3) to reduce switching transients. The stitching mechanism is started, and the support carriage drive mechanism is controlled by supplying appropriate signals on outputs X and Y to move the pallet in a predetermined pattern for stitching the portion 40 of the workpiece within the cut-out. Upon completion of this stitching operation, the presser foot is raised and the next cut-out is positioned below the sewing head, where another stitching operation is performed. Upon completion of all stitching operations, the presser foot is raised, so that the pallet may be removed, another pallet mounted on the support carriage, and the operation repeated.

If, during a stitching operation, the bobbin runs out or the thread breaks, stitching must be halted, as by depressing the STOP pushbutton, and the portion of the workpiece without thread backstitched. During backstitching, the pallet is moved to cause needle 44 to backtrack along the previously stitched path. If presser foot 42 is left in a lowered position during backstitching, it may strike the edge of a cut-out 38, causing the presser foot or the presser foot suspension bar 52 (FIG. 1) to be broken or otherwise damaged. In addition, if pallet 14 is initially misaligned with respect to support carriage 16, the presser foot may strike the pallet when it is lowered for a stitching operation, damaging the presser foot or the presser foot suspension bar. The needle and the needle bar may also strike the pallet and be damaged. In accordance with the invention, the control system of the sewing apparatus incorporates means to prevent such damage, as will now be explained.

As previously mentioned, limit switch 48 is positioned with respect to pallet 14 so that it is actuated when the pallet is mounted on the support carriage in its predetermined aligned position with respect to the support carriage. As shown in FIG. 3, limit switch 48 is connected between the START pushbutton and the supply voltage line 64, the normally open (NO) terminal of the limit switch being connected to one terminal of the START pushbutton. The normally closed terminal (NC) of the limit switch is connected to the stop control line 66 from the STOP pushbutton so that when the limit switch is not actuated, voltage from voltage supply line 64 is applied to control line 66, effectively bypassing the STOP pushbutton. This inhibits the operation of the sewing apparatus. Accordingly, a stitching operation cannot be performed until the pallet is properly aligned with and mounted on support carriage 16.

When the pallet is mounted on the support carriage in its predetermined aligned position, limit switch 48 is actuated, causing movable contact 72 (FIG. 3) to be connected to the normally open (NO) terminal of the limit switch. This removes the supply voltage from control line 66 and connects it to the START pushbutton, thus allowing operation of the START pushbutton to initiate a sewing operation.

As previously described, to lower the presser foot 42 into engagement with the workpiece, the presser foot solenoid 70 must be energized. In prior automatic sewing apparatus, one terminal of the presser foot solenoid is generally connected directly to a supply voltage line, and the other terminal of the presser foot solenoid is connected to a control circuit within the control system of the apparatus. When a cut-out is properly positioned below the sewing head for sewing, the presser foot solenoid is automatically energized by the control system to cause the presser foot to be lowered.

As shown in FIG. 3, in accordance with the invention, presser foot solenoid 70 is connected to the supply voltage line 64 through the normally closed (NC) contacts of a relay 80, and is connected to the control unit by a control line 81. Relay 80 may be controlled by a switch 82 which is operated when the BACKSTITCH pushbutton switch is operated. Switch 82 is preferably constituted as a separate set of contacts on the BACKSTITCH switch. When the BACKSTITCH switch is operated, relay coil 84 is connected to voltage supply line 64 to energize relay 80 and to move the movable contact 86 of the relay to the normally open (NO) position. This interrupts the supply voltage to the presser foot solenoid, de-energizing it, and preventing the presser foot from being lowered. Accordingly, while a backstitching operation is being performed, the presser foot is in a raised position and is prevented from striking pallet 14. Once the backstitching operation is completed, the BACKSTITCH switch is released, de-energizing relay 80 and reconnecting the presser foot solenoid to supply voltage line 64 for normal operation.

Thus, by disabling the operation of the sewing apparatus when the pallet is improperly positioned with respect to the support carriage, and by de-energizing the presser foot solenoid during backstitching, the invention prevents damage to the apparatus occasioned by the presser foot or the needle striking the pallet, and provides a solution to a long-standing problem in automatic sewing apparatus. Moreover, as is apparent from the foregoing, the invention may be quickly, easily, and inexpensively implemented in existing automatic sewing apparatus.

While a preferred embodiment of the invention has been shown and described, it will be apparent to those skilled in the art that changes can be made in this embodiment without departing from the principles and spirit of the invention, the scope of which is defined in the appended claims.

I claim:

1. In an automatic sewing apparatus having a sewing head, a pallet for holding a workpiece to be sewn, means for moving the pallet relative to the sewing head according to a predetermined pattern for stitching the workpiece and for backstitching, the sewing head including a presser foot for engaging the workpiece and needle means for stitching and backstitching the workpiece, and first and second control means for initiating stitching and backstitching, respectively, the improvement comprising means responsive to the operation of the second control means for preventing the presser foot from engaging the workpiece during backstitching.

2. The apparatus of claim 1, wherein the presser foot has solenoid means which, when energized, causes the presser foot to engage the workpiece, and wherein the preventing means comprises means for de-energizing said solenoid means.

3. The apparatus of claim 2, wherein the second control means includes switch means, and the means for de-energizing the solenoid means includes relay means operated by the switch means.

4. The apparatus of claim 3, wherein the relay means is operable to disconnect the solenoid means from a voltage source when the switch means is operated.

5. The apparatus of claim 1, wherein the means for moving the pallet includes a movable support carriage on which the pallet is adapted to be removably mounted, and wherein the apparatus further comprises sensing means for sensing predetermined alignment of the pallet with respect to the movable support carriage and for preventing operation of the apparatus when the pallet is improperly aligned with respect to the movable support carriage.

6. The apparatus of claim 5, wherein the sensing means includes switch means adapted to be operated when the pallet is in predetermined alignment with the support carriage.

7. The apparatus of claim 1, wherein the pallet comprises first and second plates adapted to confine the workpiece therebetween, the plates having aligned openings therein adjacent to areas of the workpiece to be stitched.

8. In an automatic sewing apparatus having a sewing head, a pallet for holding a workpiece to be sewn, movable support means on which the pallet is adapted to be mounted, and means for moving the support means relative to the sewing head according to a predetermined pattern for stitching the workpiece, the improvement comprising means responsive to the alignment of the pallet with respect to the support means for inhibiting the operation of the apparatus unless the pallet and the support means have a predetermined alignment.

9. The apparatus of claim 8, wherein the inhibiting means includes switch means adapted to be operated when the pallet and support means have said predetermined alignment, the switch means being effective to disable the apparatus until the switch means is operated.

10. The apparatus of claim 9, wherein the switch means applies a voltage to a stop control line of the apparatus until the switch means is operated.

11. The apparatus of claim 9 further comprising a control unit for controlling the operation of the apparatus, a start switch for applying voltage from supply voltage means to the control unit via a start control line for initiating a sewing operation, and a stop switch for applying voltage from the supply voltage means to the control unit via a stop control line for stopping the sewing operation, and wherein the switch means has a normally open terminal connected to the start switch, a normally closed terminal connected to the stop control line and a movable contact connected to the supply voltage means, the movable contact being movable between the normally open and the normally closed terminals in accordance with the operation of the switch means for alternately applying voltage to said terminals, the switch means being effective to apply voltage to the stop control line and to disconnect the start switch from the voltage supply means until the switch means is operated.

* * * * *